US005177537A

United States Patent [19]

Okano et al.

[11] Patent Number: 5,177,537

[45] Date of Patent: Jan. 5, 1993

[54] DEVELOPING APPARATUS WITH ELASTIC REGULATING MEMBER URGED TO A DEVELOPER CARRYING MEMBER

[75] Inventors: Keiji Okano, Yokohama; Hiroto Hasegawa, Kawasaki; Toshio Miyamoto, Tokyo; Katsuhiko Nishimura; Tatsunori Ishiyama, both of Yokohama, all of Japan

[73] Assignee: Canon Kabushiki Kaisha, Tokyo, Japan

[21] Appl. No.: 630,850

[22] Filed: Dec. 20, 1990

[30] Foreign Application Priority Data

Dec. 20, 1989 [JP] Japan ..... 2-332202
Jun. 29, 1990 [JP] Japan ..... 3-173765

[51] Int. Cl.[5] ..... G03G 15/06

[52] U.S. Cl. ..... 355/259; 118/658; 355/253

[58] Field of Search ..... 355/245, 251, 253, 259, 355/361, 265; 118/657, 658, 656, 647, 651, 661

[56] References Cited

U.S. PATENT DOCUMENTS 4,356,245 10/1982 Hosono et al. ..... 430/122
4,395,110 7/1983 Hosono et al. ..... 118/657 X
4,458,627 7/1984 Hosono et al. ..... 118/657
4,616,918 10/1986 Kohyama et al. ..... 118/261 X
4,814,818 3/1989 Fuma et al. ..... 355/253
4,847,653 7/1989 Doi et al. ..... 355/245
4,876,574 10/1989 Tajima et al. ..... 355/253
4,989,044 1/1991 Nishamura et al. ..... 355/251
5,010,370 4/1991 Araya et al. ..... 355/274

FOREIGN PATENT DOCUMENTS 1-276174 11/1989 Japan .
1-277264 11/1989 Japan .

OTHER PUBLICATIONS

U.S. Patent Application Ser. No. 07/664,227 (filed Mar. 4, 1991).
U.S. Patent Application Ser. No. 07/261,999 (filed Oct. 25, 1988).

*Primary Examiner*—A. T. Grimley
*Assistant Examiner*—Christopher Horgan
*Attorney, Agent, or Firm*—Fitzpatrick, Cella, Harper & Scinto

[57] ABSTRACT

A developing apparatus for developping an electrostatic latent image includes a movable developer carrying member facing toward or contacted with an image bearing member in a developing zone. An elastic regulating member for forming a regulated developer layer on the developer carrying member is elastically urged toward the developer to form a nip therebetween, through which the developer is conveyed to the developing zone. Fine particles different from particles constituting the developer are arranged on the surface of the regulating member comprising the nip.

17 Claims, 6 Drawing Sheets

DEVELOPING APPARATUS WITH ELASTIC REGULATING MEMBER URGED TO A DEVELOPER CARRYING MEMBER

FIELD OF THE INVENTION AND RELATED ART

The present invention relates to a developing apparatus for developing an electrostatic latent image, more particularly to a developing apparatus having a developer carrying member and an elastic developer regulating member elastically urged to the developer carrying member.

U.S. Pat. Nos. 4,458,627 and 4,356,245 disclose a developing apparatus wherein an elastic blade made of rubber or the like is elastically urqed to a developer carrying sleeve to form a nip therebetween, through which one component developer not containing carrier particles is passed, by which a thin layer of the developer is formed on a developer carrying sleeve. In such an apparatus, the developer is actively rubbed in the nip, and therefore, the developed image as a sufficient image density.

However, since the elastic blade is press-contacted to the sleeve in such an apparatus, the driving torque required for rotating the sleeve is large during an initial stage after the start of use of the developing apparatus. Sometimes, the sleeve does not rotate smoothly. If this occurs, the developed image is not uniform.

In addition, during the initial stage, for example, until 300 sheets are printed from the start of the use of the developing apparatus, the density of the developed image gradually increases from relatively low density. The reason is considered to be that during the initial stage, the motion of the developer in the nip is relatively inactive with the result of insufficient triboelectric charge to the developer. In fact, the triboelectric charge distribution of the developer on the sleeve is wide, and the average charge amount is low, as show in FIG. 1, during the initial stage.

After approximately 300 sheets are processed, the triboelectric charge distribution becomes sharp, and the average triboelectric charge becomes high, as shown in FIG. 2. This is because, the developer is circulated and stirred adjacent the sleeve, and the developer particles are sufficiently triboelectrically charged by the friction with the sleeve and the blade.

On the other hand, with the repeated operations, the nip between the developing sleeve and the developer regulating blade is clogged with the developer, and the developer is coagulated, by which the triboelectric charging action becomes instable, and therefore, the conveyance of the developer on the developing sleeve becomes also instable.

Furthermore, with repeated operation, the developer is repeatedly rubbed with the developing sleeve and the developer regulating blade, and as a result, the material such as pieces of the resin materials which are not consumed for the developing action are fused on the developer regulating blade, or the binder resin of the developer is fused on the developer regulating blade, which form a film covering it. Therefore, the surface properties of the developer regulating blade are deteriorated.

For the reasons stated above, the developed image involves stripes and non-uniformity.

SUMMARY OF THE INVENTION

Accordingly, it is a principal object of the present invention to provide a developing apparatus wherein a developer carrying member is smoothly moved from the initial stage immediately after the start of the use of the developing apparatus.

It is another object of the present invention to provide a developing apparatus wherein the developer can be properly triboelectrically charged from the initial stage after the start of the use of the developing apparatus so that the developed image has sufficient image density from the initial stage.

It is a further object of the present invention to provide a developing apparatus in which fusing and accumulation of a component of the developer on the elastic regulating member can be prevented.

It is a yet further object of the present invention to provide a developing apparatus wherein a nip formed between a elastic developer regulating member and a developer carrying member is protected from being clogged with the developer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 4:
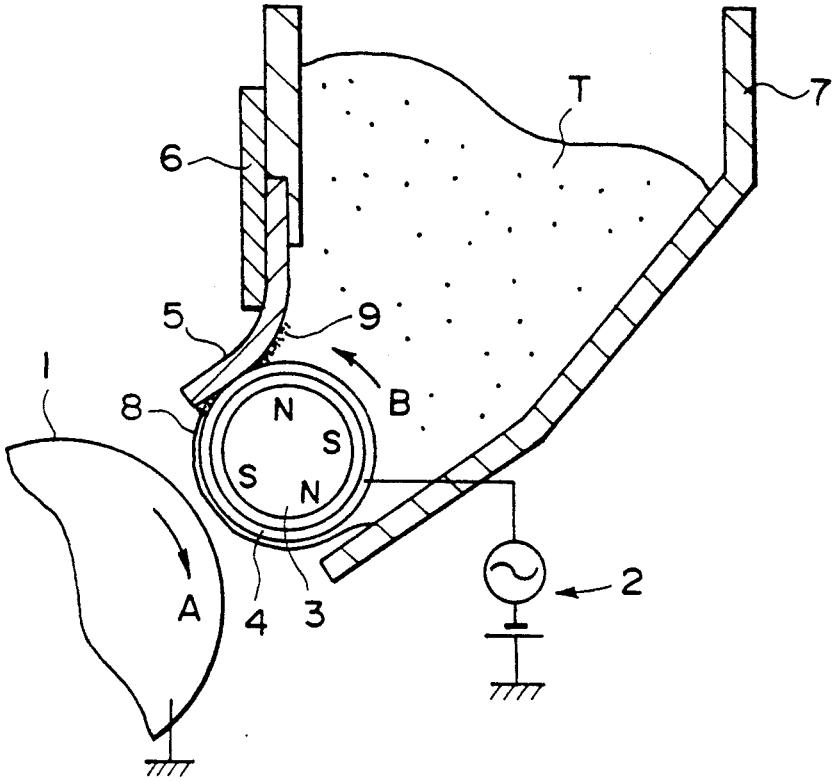
FIG. 4 is a sectional view of a developing apparatus according to an embodiment of the present invention.

Referring to FIG. 4, there is shown a developing apparatus according to an embodiment of the present invention. Designated by a reference numeral 1 is an electrophotographic photosensitive drum carrying an electrostatic latent image. The photosensitive drum 1 is rotated in a direction indicated by an arrow A, during which it is negatively charged by a primary charger to a potential, for example, Vd = −650 V, uniformly. Thereafter, the photosensitive drum 1 is exposed to a laser beam or the like modulated in accordance with an image to be recorded, by which the image portion potential (light potential) V1 is attenuated to −100 V, for example, so that a negative electrostatic latent image is formed.

The developing apparatus of this embodiment, as shown in FIG. 4, comprises a developer container 7 containing toner T which is a one component developer of insulating and magnetic nature and a developing sleeve 4 which is faced to the photosensitive drum 1 in a developing zone. The developing sleeve 4 is made of non-magnetic and electrically conductive material such as aluminum, and the surface thereof has been roughened by sandblasting or the like. The developing sleeve 4 carries thereon the toner T in the developer container 7 by the magnetic force provided by a magnet roll 3 within the developing sleeve 4. The developing sleeve 4 rotates in a direction B to carry the toner T to the developing zone where the photosensitive drum 1 and the developing sleeve 4 are faced to each other.

An elastic blade 5 is supported on a supporting plate 6 and is press-contacted to the developing sleeve 4 elastically by its only elasticity. That is, the blade 5 is elastically urged to the sleeve 4 to form a nip therewith. In this embodiment, the elastic blade 5 is made of urethane rubber having a thickness of 1.0 mm and a hardness of 65 degrees and is press-contacted to the developing sleeve 4 with a line pressure of 15 g/cm along the length of the sleeve. The thickness of the toner layer on the developing sleeve 4 is regulated by the nip to form a layer 8 of the toner T which is smaller than the minimum gap between the photosensitive drum 1 and the developing sleeve 4 in the developing zone. Thus, a so-called non-contact type developing operation is carried out in the developing zone. The toner layer 8 on the developing sleeve 4 is erected by a developing magnetic pole of the magnet roll 3.

The toner is mainly triboelectrically charged to a negative polarity by the friction with the sleeve, so that the latent image is reverse-developed. When the toner passes through the nip, the toner is rubbed with the sleeve and the blade 5 to be triboelectrically charged to such an extent as to provide sufficient image density of the developed image.

The developing sleeve 4 is supplied with a developing bias voltage from a bias source 2. The developing bias is a DC biased AC voltage, for example, having a peak-to-peak voltage of 1400 V and a frequency of 1800 Hz in the form of a rectangular wave, the DC component being −500 V, for example. By the application of such a voltage, a vibratory electric field is formed in the developing zone to develop the electrostatic latent image on the photosensitive drum with the toner T from the toner layer 8 on the developing sleeve 4. In this embodiment, since the reverse-development is effected, the toner is deposited to the region of the photosensitive drum 1 which has the potential of V1.

In this embodiment, the developing bias voltage has a positive phase and a negative phase periodically and alternately. However, the developing bias may periodically changes within a negative polarity or within a positive polarity. Further alternatively, the voltage may be constant, that is, a DC bias voltage.

In this embodiment, the magnetic toner comprises:

| | |
|---|---|
| Styrene-butyl methacrylate copolymer (copolymerization weight ratio = 8:2) (Mw = 270,000) | 100 parts |
| Magnetic particles (magnetite, BET = 8.0 $m^2/g$) | 50 parts |
| Low molecular weight polypropylene (Mw = 6,000) | 4 parts |
| Negative charge controlling agent (chrome complex of monoazo dye) | 2 parts |

Those materials are mixed, needed, roughly pulverized, finely pulverized and classified, so that classified toner having a volume average particle size of 10 microns is produced. To the toner powder (100 parts by weight) is mixed with silica fine particles (0.9 part by weight) treated with dimethylsilicone oil for the purpose of increasing fluidability of the toner and for the purpose of controlling the electric charge of the toner, the silica particles being triboelectrically charged to the sam polarity as the toner. In this specification, the average particle size means a volume average particle size.

That surface of the elastic blade 5 which is contacted to the developing sleeve, that is, the surface of the elastic blade 5 cooperative with the developing sleeve 4 to form the nip, is coated with resin particles 9 electrically chargeable to a positive polarity which is the opposite from the polarity of the toner, when they are rubbed with the toner. The coating is effected prior to the initial start of the operation of the developing apparatus. For example, the fine resin particles are applied on paper or cloth, for example, and are applied to the surface of the elastic blade while rubbing with the surface. The images were produced using the developing apparatus of this embodiment. It was confirmed that the image density of the solid black image was 1.42, and the density of a black image having a regular square configuration of 5×5 mm (5 mm square density) was 1.45 (both from the initial stage of the start of the use). With the developing apparatus wherein the resin particles were not applied, the solid black image density was 1.35, and 5 mm square density was 1.39. Until the density reached a satisfactory level, 300 sheets had to be processed.

Therefore, the fine particles 9 are effective to improve the parting nature between the blade and the toner particles, the lubrication therebetween, thus enhancing the rolling of the toner particles in the nip. Therefore, the friction between the toner and the sleeve is activated to apply sufficient triboelectric charge to the toner. If the selection is made such that the blade 5 is triboelectrically charged to the polarity opposite from that of the toner, by which the toner is further charged by the friction with the blade 5.

In addition, the fine particles applied to the elastic blade are such that they are triboelectrically charged to the polarity opposite from that of the toner by the friction with the toner particles in this embodiment, the toner particles are further charged by the friction with the fine particles, and therefore, it is further preferable.

The fine particles 9 are effective to reduce the torque required for the rotation of the sleeve 4, and therefore, the sleeve 4 is smoothly rotated from the initial stage of the start of the use of the developing apparatus. This prevents non-uniform development attributable to the non-uniform rotation of the developing sleeve 4. The fine particles 9 are further effective to prevent the nip between the blade 5 and the sleeve 4 from being clogged and are effective to prevent the binder of the developer from being fused on the blade 5.

The effects of the fine particles 9 continue in this embodiment until 200 sheets are printed. With the number of prints, the effects of the fine particles 9 relatively decreases. On the other hand, however, with the increase of the number of prints, the toner adjacent to the sleeve 4 in the container 7 come to be supplied with some level of electric charge by the friction with the sleeve 4, and in addition, that surface of the sleeve 5 constituting the nip with the sleeve 4 receives fine silica particles in the developer, and therefore, the motion of the toner in the nip is activated by the silica particles. Accordingly, the toner is triboelectrically charged by the friction with the sleeve 4 and the friction with the blade 5 to sufficient extent.

After 300 sheets are printed, the fine silica particles in the toner are sufficiently applied to that surface of the elastic blade so as to constitute a layer of the silica particles. Mainly by the silica particles, the parting property between the blade 5 and the toner is enhanced, so that the rolling of the toner particles in the nip between the elastic blade and the sleeve is activated to accomplish the sufficient triboelectric charging.

The positively chargeable fine particles 9 function to electrostatically attract the fine silica particles contained in the developer, thus promoting the formation of the silica layer on that surface of the elastic blade 5.

The particles applied on the elastic blade preferably have a volume average particle size which is smaller than a volume average particle size of the toner particles, further preferably it is not more than on fifth the average particle size of the toner. The volume average particle size is measured by Coulter counter.

The positively chargeable fine resin powder 9 is produced by spray-dry method, suspension polymerization method, emulsion polymerization method, seed polymerization method or the like. From the point of maintaining the configurations of the particles, the fine resin particles have a weight average molecular weight of 10,000–200,000 measured by GPC chromatography. Usable materials for the fine resin particles 9 include methyl methacrylate, dimethylaminoethyl methacrylate, diethylaminoethyl methacrylate, N-methyl-N-phenylaminoethyl methacrylate, diethylaminoethyl methacrylamide, dimethylaminoethyl methacrylamide, 4-vinylpyridine, 2-vinylpyridine and other vinyl monomer or mixture of such monomers, which are polymerized.

For the purpose of providing the resin particles with the positively chargeable property, a copolymerization initiator containing nitrogen is usable, and, monomer containing nitrogen-containing vinyl-monomer may be polymerized.

The volume average particle size of the fine resin particles 9 is preferably 0.1–1.0 micron, and the amount of the triboelectric charge thereof is preferably 50–600 micro-coulomb/g.

The next embodiment is intended to extend the effects of the fine resin particles. That surface of the elastic blade 5 which is contactable to the developing sleeve is roughened, and thereafter, the fine resin particles are applied.

Figure 5:
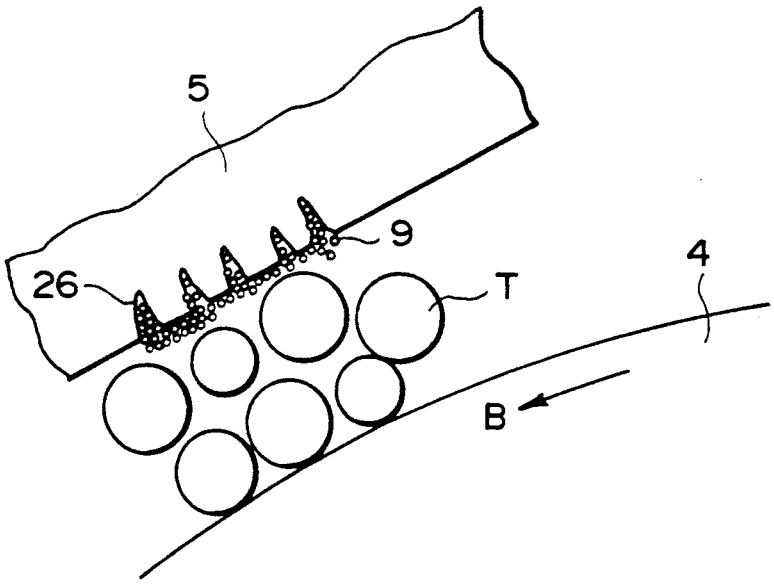
FIG. 5 is a sectional view of a part of the developing apparatus according to another embodiment.

FIG. 5 shows the blade in this embodiment. The surface of the elastic blade 5 contacted to the sleeve 4 has fine pits 26. The surface roughness is preferably smaller than the volume average particle size of the toner so as not to obstruct the rolling of the toner. It is further preferable that the surface roughness is smaller than the particle size of the toner contributable to the development, more particularly, the average roughness Ra (JIS) is preferably 0.1–5 microns.

In this embodiment, the surface roughness Ra is approximately 1.0 micron, and the pits thereof exist along a direction substantially perpendicular to the peripheral movement of the rotatable developing sleeve 4 (longitudinal direction of the blade). In this embodiment, the surface roughness is provided by integrally molding the rubber blade 5 and the blade supporting member 6 with rubber material. The molding surface has the corresponding roughness. In this specification, the surface roughness is the one defined in accordance with central average roughness Ra (JIS). By applying the fine particles 9 to the roughened surface of the elastic blade 5, the fine particles 9 are retained in the pits of the blade, as shown in FIG. 5. Therefore, the effects of increasing the image density can be continued. Accordingly, the images having sufficient image density can be stably provided from the initial stage for a long period of time.

A developing apparatus has been proposed wherein the developing sleeve has a surface resin layer containing fine conductive carbon particles and fine graphite particles (solid lubricant) dispersed therein (Japanese Laid-Open Patent Application No. 277265/1989 and Japanese Laid-Open Patent Application No. 276174/1989 corresponding to U.S. Ser. No. 341,352). The developing apparatus prevents over charge of the toner on the developing sleeve to stabilize the charging of the toner, and therefore, it is excellent. However, the triboelectric charge amount of the toner at the initial stage of the start of the use of the developing apparatus is further lower.

In referring to FIG. 6, the description will be made as to an embodiment wherein the present invention is applied to the developing apparatus having a developing sleeve provided with a surface layer made of conductive resin.

Figure 6:
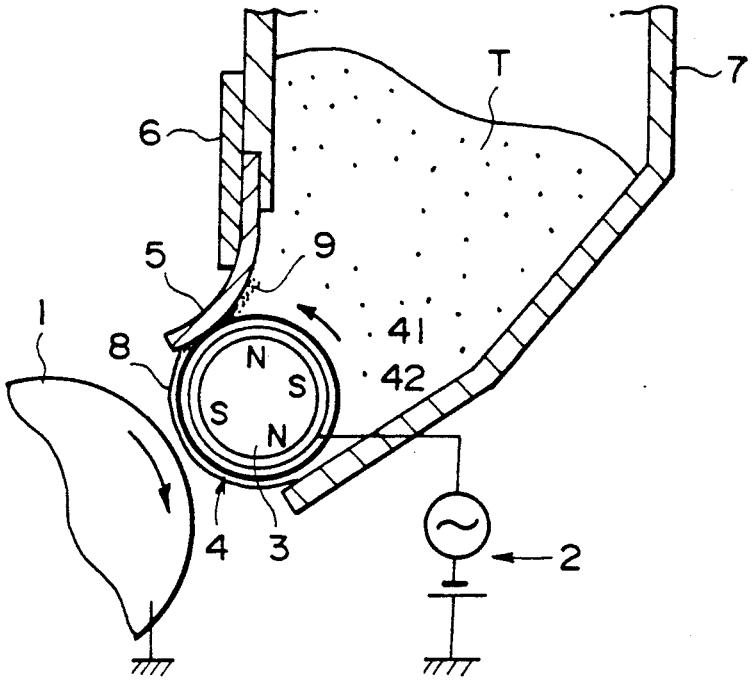
FIG. 6 is a sectional view of a developing apparatus according to a further embodiment of the present invention.

As shown in FIG. 6, the sleeve 4 comprises a conductive sleeve 41 and a surface resin layer 42. The resin layer 42 is produced by mixing 50% by weight of phenol resin binder, 5% by weight of conductive carbon fine particles (CONDUCTEX 900, available from Columbia Ink) and 45% by weight of graphite fine particles (CSPE, available from Nihon Kokuen Kabushiki Kaisha) and diluting it with methyl cellosolve and methanol and then spraying it on the surface of the conductive sleeve 41 into a film thickness of 150 microns. The resin is heat-cured at 150° C. for 30 min. The average central roughness Ra of the surface is 0.3–5.0 microns, and the volume resistivity is $5.0\times10^{0}$ ohm.cm.

The other conditions other than those relating to the sleeve 4, are the same as in embodiment 1 (FIG. 4). The solid black image had the density of 1.42 at the initial stage, and the 5 mm-square density was 1.45. With the time of use, the density changes, and the stabilized image without sleeve ghost was produced.

When the elastic blade was not coated with the fine particles 9, the solid black image density was 1.30, and the 5 mm-square density of 1.35, at the initial stage. In addition, until the sufficient density is reached, 500 sheets had to be processed.

Figure 1:
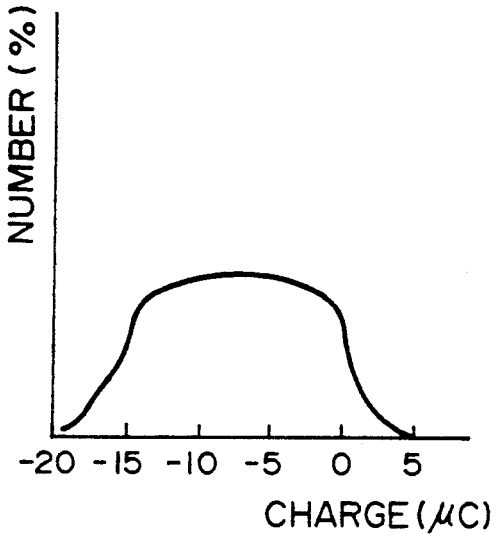
FIG. 1 PRIOR ART
FIG. 1 is a graph of triboelectric charge distribution of a developer at an initial stage after start of use of a conventional developing apparatus.
Figure 2:
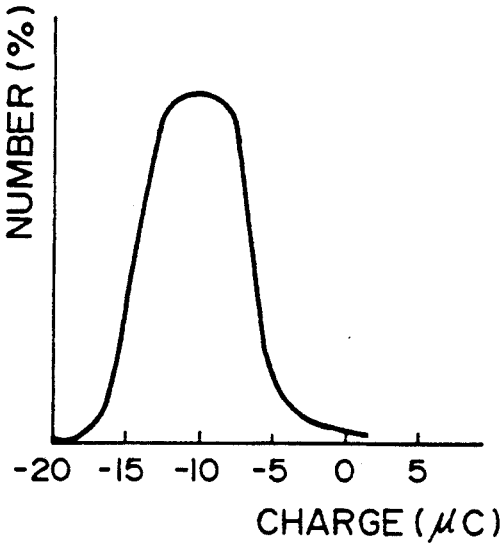
FIG. 2 PRIOR ART
FIG. 2 is a graph of a triboelectric charge distribution of the developer after the developing apparatus of FIG. 1 is operated for a substantial period of time.
Figure 3:
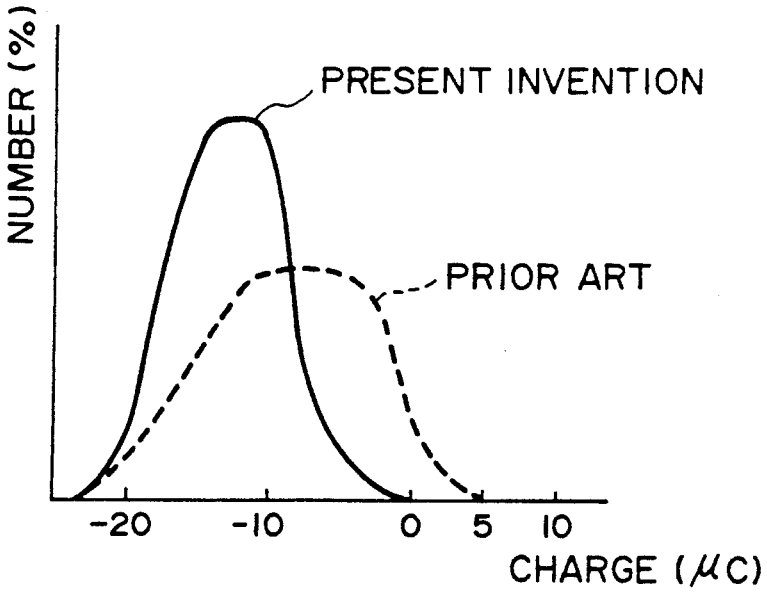
FIG. 3 is a graph comparing the triboelectric charge distributions of the developer according to the present invention and according to prior art.
Figure 9:
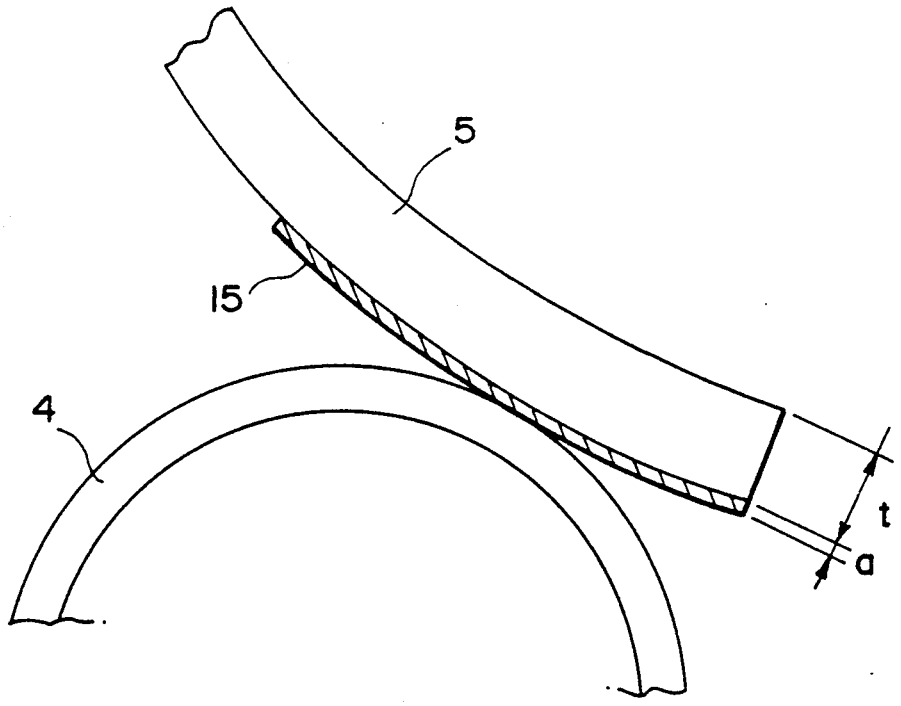
FIG. 9 is a sectional view of a part of a developing apparatus according to a further embodiment of the present invention.

FIG. 3 is a graph showing the results of measurements of the triboelectric charge distribution of the toner in the initial stage of the start of the use of the developing apparatus according to the embodiment of FIG. 9 and a conventional developing apparatus. It will be understood that the distribution is sharper, and the amount of electric charge is higher in the apparatus of this invention than in the conventional apparatus. The present invention is particularly effective in the developing apparatus having a sleeve provided with conductive resin surface layer. The triboelectric charge of the toner is made higher from the start of the use, and the distribution thereof is made sharp to provide the high image density from the start of the use of the apparatus.

Figure 7:
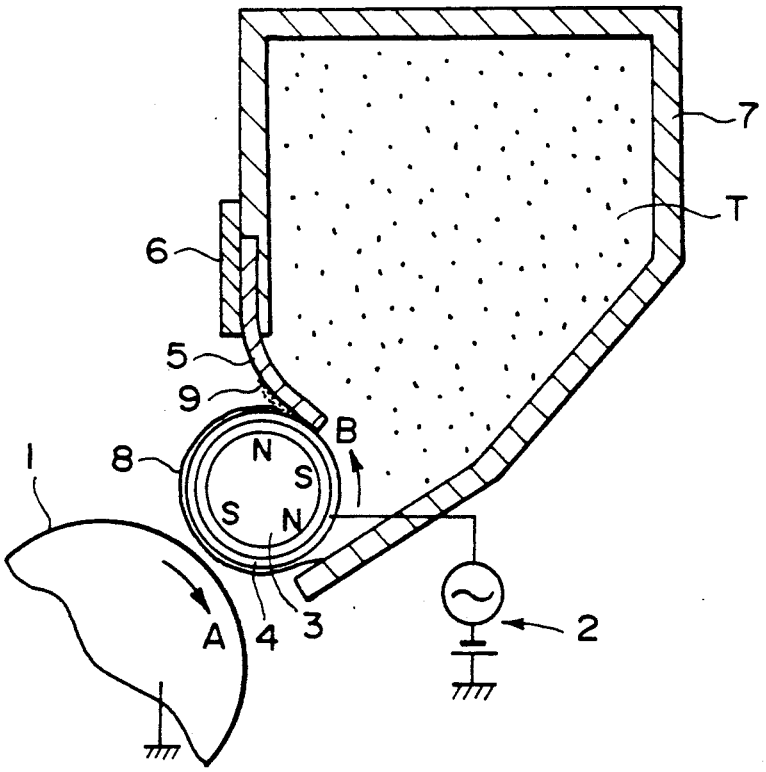
FIG. 7 is a sectional view of a developing apparatus according to a further embodiment of the present invention.

In the foregoing embodiment, the elastic blade 5 is contacted to the surface of the sleeve 4 codirectionally with the rotational direction of the sleeve 4. That is, the free end of the blade 5 is disposed downstream of the fixed end of the holder 6 with respect to the rotational direction of the sleeve. However, as shown in FIG. 7 it may be contacted to the sleeve surface counter directionally with respect to the rotational direction of the sleeve 4. That is, the free end of the blade is upstream of the fixed end to the holder 6 with respect to the rotational direction of the sleeve.

In the following embodiments, the elastic blade 5 has a resin layer 15 containing dispersed solid lubricant particles at the contact surface to the developing sleeve 4, in order to prevent the toner T or the like is packed in the nip between the developing sleeve 4 and the elastic blade 5 and from the toner T or the like from fusing on the elastic blade 5.

In FIG. 9, which is an enlarged view of the nip formed between the elastic blade 5 and the developing sleeve 4, the elastic blade 5 has a thickness of $t=1.0$ mm and is provided with a resin layer 15 having a thickness $a=20$ microns. The elastic blade 5 is made of urethane rubber having a rubber hardness of 60 degrees.

An example of the resin layer 15 containing the solid lubricant is as follows:

| | |
|---|---|
| Resin:phenol resin (solid) | 30 parts by weight |
| Conductive solid lubricant:artificial graphite (average particle size of 7 microns) | 25 parts by weight |
| Diluent:methyl alcohol and methylcellosolve | 200 parts by weight |

The resin liquid containing the above components is applied onto the surface of the elastic blade 5 by spray or dipping method into a thickness of 5–100 microns, and then it is heat-cured at 150° C. for 30 min. in a drying furnace to produce a resin layer 15 containing the solid lubricant on the elastic blade 5. The volume resistivity of the resin layer 15 was $1.0\times10^2$–$1.0\times10^3$ ohm.cm.

Figure 8:
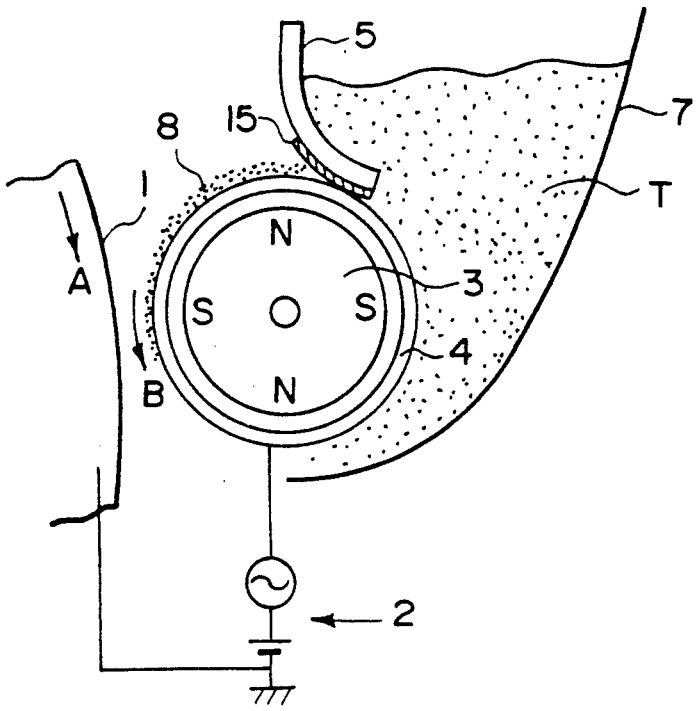
FIG. 8 is a sectional view of a developing apparatus according to a further embodiment of the present invention.

In this embodiment, the elastic blade 5 thus produced is incorporated in the developing apparatus shown in FIG. 8, and the electrostatic latent image on the photosensitive drum 1 was developed, and a printed image was produced. As a result, the wearing of the resin layer 15 of the elastic blade 5 was approximately 3 microns even after 10,000 sheets were printed, and the resin powder component in the toner T did not fuse on the elastic blade 5.

In the nip between the developing sleeve 4 and the elastic blade 5, the resin layer is effective to prevent coagulation of the toner T, and therefore, the resultant image was free from stripe or non-uniformity. This is because the solid lubricant in the resin layer 15 is effective to scrape the surface of the resin layer 15 with the printing operation, and therefore, to provide refreshed surface of the resin layer 15. Since the resistance of the resin layer 15 is small, the charging of the toner T is not influenced.

In addition, the solid lubricant of the resin layer 15 is effective to reduce the resistance against the rotation of the sleeve 4 at the nip, and therefore, the sleeve 4 is able to rotate smoothly from the start of the use of the apparatus, and therefore, the image non-uniformity attributable to the non-uniform rotation can be prevented.

Furthermore, the sliding is improved by the solid lubricant between the resin layer 15 and the toner. From the start of the use of the developing apparatus, the toner moves actively in the nip so that the toner is triboelectrically charge by the friction with the sleeve 4 and the blade 5 to sufficient extent, and therefore, the high image density can be provided from the start of the use.

The resin layer 15 is worn by the friction with the developing sleeve 4, and therefore, the surface roughness of the resin layer 15 and the configurations of the surface are not significant, and therefore, the formation of the resin layer 15 is easy.

In this embodiment, the solid lubricant contained in the resin layer 15 was electrically conductive artificial graphite. Other usable materials include molybdenum disulfide particles, boron nitride particles, and silica particles with the same advantageous effects. The binder resin used in the resin layer 15 is not limited to the phenol resin. Other usable materials include thermocuring resin.such as epoxy resin or melamine resin. An ultraviolet-curing resin is also usable. The binder resin is preferably has a charging property to the polarity opposite from that of the toner.

The resin layer 15 has been described as containing the solid lubricant only, but in order to reduce the electric resistance of the resin layer 15, the resin layer 15 may contain conductive fine particles such as carbon.

The elastic blade 5 may be made of resin elastomer such as polyethylene terephthalate (PET).

An attempt has been made to use the resin elastomer as the elastic blade. The resin elastomer is advantageous in that the cost is lower than the rubber elastomer. However, the Young's modulus is larger by 2 –3 orders, and the hardness thereof is high, and therefore, when the elastic blade made of the material is contacted to the developing sleeve 2, it has been difficult to form a uniform nip between the elastic blade and the developing sleeve 4.

According to the present invention, even if the elastic blade 5 is made of resin elastic material, the resin layer 15 containing the solid lubricant is formed, and therefore, the nip between the elastic blade 5 and the developing sleeve 4 becomes uniform.

In this embodiment, the elastic blade has a thickness of 0.5 mm and is made of polyethylene terephthalate. On this elastic blade 5, a resin layer 15 of approximately 50 micron thickness containing the solid lubricant was formed, similarly to the foregoing embodiments. The elastic blade 5 is incorporated in the developing apparatus of FIG. 8. The elastic blade 5 was press-contacted to the developing sleeve 4 with the line pressure of 20 g/cm. The same developing operation as in the foregoing embodiments was carried out to repeat the printing operations.

As a result, the wearing of the resin layer 15 at the nip between the elastic blade 5 and the developing sleeve 4 was larger, but the uniform nip can be ensured throughout the repeated printing operations. In addition, the toner T did not fuse on the elastic blade 5. No stripes or non-uniformity was recognized on the resultant images. At the initial stage of the start of the use of the developing apparatus, the toner is sufficiently triboelectrically charged, and therefore, high density images could be produced.

The developing sleeve 4 may be produced by coating the surface of the metal sleeve with conductive resin described in conjunction with FIG. 6, by impression molding with the conductive resin with or without the surface roughened.

Figure 10:
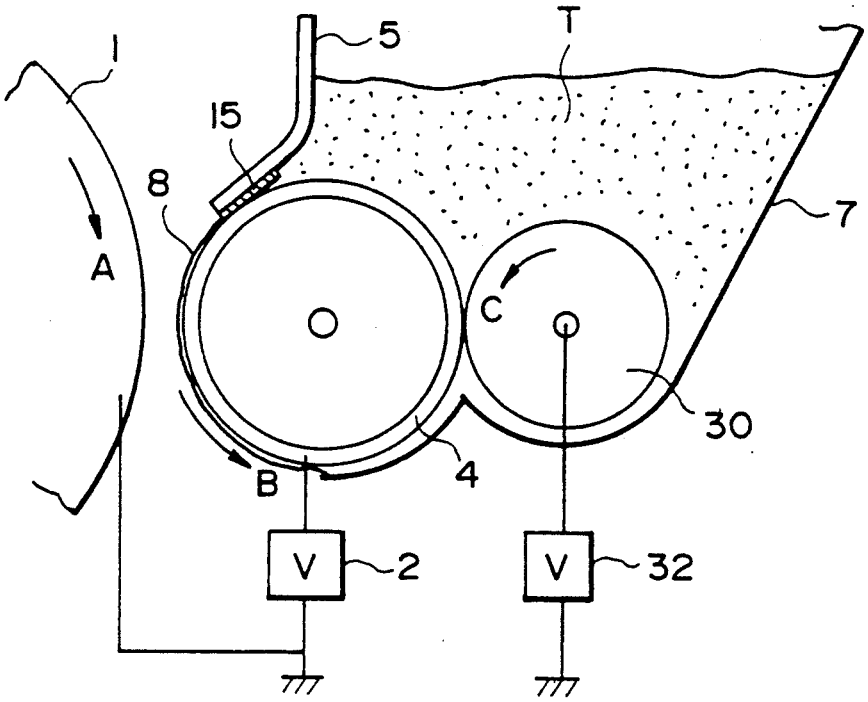
FIG. 10 is a sectional view of a developing apparatus according to a further embodiment.

FIG. 10 shows a developing apparatus according to another embodiment. The one component developer in the developer container 7 is non-magnetic insulative toner T. A conductive sponge rubber roll 30 is contacted to the sleeve 4 made of metal such as stainless steel and is rotated in a direction C, by which the toner T is applied on the developing sleeve. This embodiment is the same as in the foregoing embodiments in the other respects. A voltage source 32 applies to the roller 30 a DC biased AC voltage or an AC voltage, by which the motion of the toner from the roller 30 to the sleeve 8 is promoted.

Figure 11:
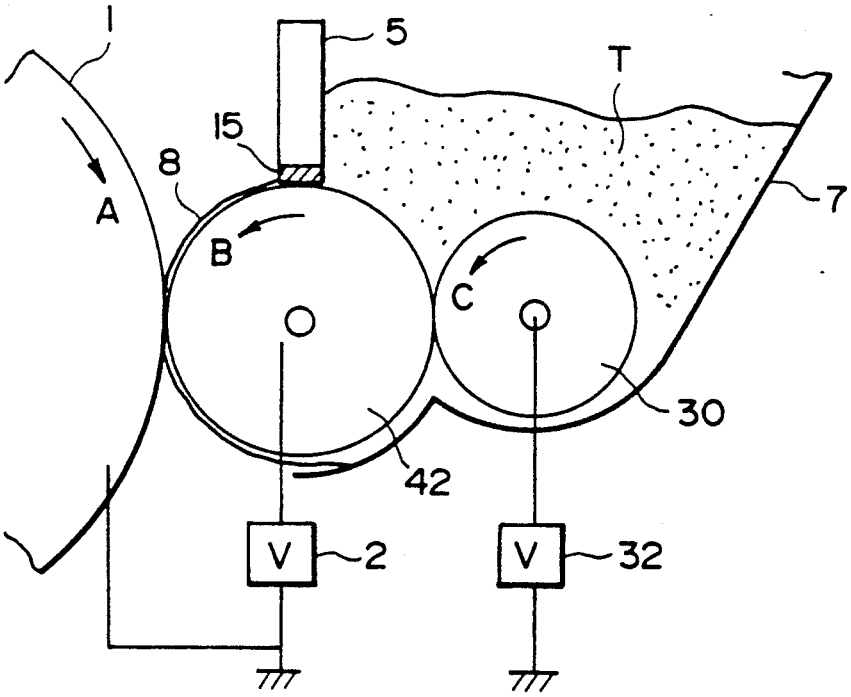
FIG. 11 is a sectional view of a developing apparatus according to a further embodiment.

FIG. 11 shows another embodiment of the developing apparatus. The one component developer toner T in the developer container 7 is a non-magnetic insulative toner. A developing roll 42 is made of semiconductive elastic material (preferably rubber) and is rotated in a direction B in contact with the photosensitive member 1. A conductive sponge roll 30 functions to apply the toner T to the developing roll 42. An elastic blade 5 has at its bottom surface a resin surface layer 15 contacted to the developing roll 42, the resin layer 15 comprising a solid lubricant. The elastic blade 5 is contacted to the developing roll 42 perpendicularly. The elastic blade 5 functions to regulate the toner T on the developing roll 42 to form a thin layer of toner. While the toner layer 8 on the developing roll 42 is in contact with the photosensitive drum 1 in the developing zone, a DC voltage or a DC biased AC voltage is applied as a developing bias to the developing sleeve 4 from the bias source 6, so that a developing operation is effected.

Figure 12:
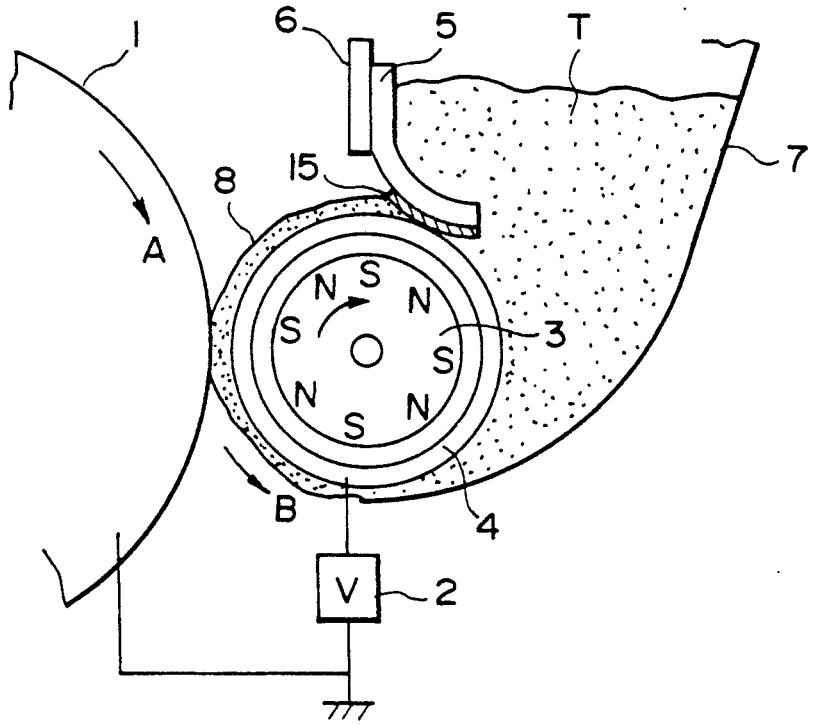
FIG. 12 is a sectional view of a developing apparatus according to a further embodiment.

In FIG. 12 embodiment, the elastic blade having the resin layer 15 is contacted to the sleeve 4 in the counter direction with respect to the peripheral movement of the sleeve 4. In this embodiment, the one component developer T in the developer container 7 is a magnetic toner, and the magnet roll 3 has N-poles and S-poles alternately, the magnet roll 3 being in the sleeve 4. The magnet roll 3 is located in the direction opposite form the rotational direction of the developing sleeve 4, by which the toner T is carried on the developing sleeve 4. With the photosensitive drum 1 and the toner layer 8 on the developing sleeve being contacted to each other in the developing zone, the bias voltage source 6 applies to the developing sleeve 4 as the developing bias a DC voltage or a DC biased AC voltage to effect the developing operation.

The present invention is applicable to the developing apparatus using the magnetic developer or a non-magnetic developer. The charging polarity of the toner may be positive or negative. The development is not limited to the reverse-development wherein the right potential region of the latent image receives the toner, but also to a regular development wherein the dark potential region of the latent image receives the toner. As described in the foregoing, the present invention is applicable both to a so-called contact type development and to a so-called non-contact type development. The bias voltage applied to the developer carrying member is preferably an AC voltage, but may be a DC voltage.

As for the elastic regulating member, silicone rubber blade, nitrile rubber blade, a thin phosphor bronze leaf spring or a thin stainless steel leaf spring or the like is usable. It is preferable that a blade having rubber elasticity is bonded to such a metal leaf spring to elastically urge the rubber elastic blade to the developer carrying member, from the standpoint of increasing the resistance against the plastic deformation of the blade.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a movable developer carrying member for carrying a particle developer facing toward or contacted to an image bearing member in a developing zone;

an elastic regulating member for forming a regulated developer layer on said developer carrying member, said regulating member being elastically urged toward said developer carrying member to form a nip therebetween, through which the developer is conveyed to the developing zone; and fine particles, different from particles constituting the developer arranged on a surface of said regulating member comprising the nip;

wherein an average particle size of said fine particles is smaller than an average particle size of particles constituting the developer.

2. An apparatus according to claim 1, wherein a triboelectric charge polarity of said fine particles is opposite from a triboelectric charge polarity of the developer.

3. An apparatus according to claim 2, wherein said fine particles are resin particles.

4. An apparatus according to claim 3, wherein fine silica particles are added to the developer.

5. An apparatus according to claim 3, wherein the surface of said regulating member comprising the nip has a surface roughness smaller than the average particle size of particles constituting the developer, and said fine particles are retained on the surface of said regulating member comprising the nip.

6. An apparatus according to claim 2, wherein said developer carrying member has a resin surface layer in which graphite is dispersed.

7. An apparatus according to claim 2, wherein said regulating member regulates a layer of the developer on said developer carrying member so that the layer has a thickness smaller than the minimum gap between the image bearing member and said developer carrying member in the developing zone.

8. An apparatus according to claim 7, further comprising a voltage source for applying a bias voltage to said developer carrying member to form a vibratory electric field in the developing zone.

9. A developing apparatus for developing an electrostatic latent image, comprising:

a movable developer carrying member for carrying a developer facing toward or contacted to an image bearing member in a developing zone;

an elastic regulating member for forming a regulated developer layer on said developer carrying member, said regulating member being elastically urged toward said developer carrying member to form a nip therebetween, through which the developer is conveyed to the developing zone;

wherein said elastic regulating member comprises a resin layer in which solid lubricant particles are arranged on a surface of said regulating member comprising the nip.

10. An apparatus according to claim 9, wherein said solid lubricant particles contain material selected from the group consisting of graphite, molybdenum disulfide, boron nitride and silica.

11. An apparatus according to claim 9 or 10, wherein said regulating member regulates a layer of the developer on said developer carrying member so that the layer has a thickness smaller than the minimum gap between the image bearing member and said developer carrying member in the developing zone.

12. An apparatus according to claim 11, further comprising a voltage source for applying a bias voltage to said developer carrying member to form a vibratory electric field in the developing zone.

13. A developing apparatus for developing an electrostatic latent image, comprising:

a movable developer carrying member for carrying a developer facing toward or contacted to an image bearing member in a developing zone;

an elastic regulating member for forming a regulated developer layer on said developer carrying member, said regulating member being elastically urged to said developer carrying member to form a nip therebetween, through which the developer is conveyed to the developing zone; and fine resin particles, different from particles constituting the developer, arranged on a surface of said regulating member constituting the nip;

wherein a triboelectric charge polarity of said fine resin particles is opposite from a triboelectric charge polarity of the developer, and wherein said developer carrying member has a resin surface layer in which graphite is dispersed.

14. A developing apparatus for developing an electrostatic latent image, comprising:

a movable developer carrying member for carrying a developer facing toward or contacted to an image bearing member in a developing zone;

an elastic regulating member for forming a regulated developer layer on said developer carrying member, said regulating member being elastically urged to said developer carrying member to form a nip therebetween, through which the developer is conveyed t the developing zone; and fine resin particles, different from particles constituting the developer, arranged on a surface of said regulating member constituting the nip;

wherein a triboelectric charge polarity of said fine resin particles is opposite from a triboelectric charge polarity of the developer, and wherein the surface of said regulating member comprising the nip has a surface roughness smaller than an average particle size of particles constituting the developer, and said fine particles are retained on the surface of said regulating member constituting the nip.

15. An apparatus according to claim 14 wherein said developer carrying member has a resin surface layer in which graphite is dispersed.

16. An apparatus according to claim 13, 14 or 15, wherein said regulating member regulates a layer of the developer on said developer carrying member so that the layer has a thickness smaller than the minimum gap between the image bearing member and said developer carrying zone.

17. An apparatus according to claim 16, further comprising a voltage source for applying a bias voltage to said developer carrying member to form a vibratory electric field in the developing zone.

* * * * *

UNITED STATES PATENT AND TRADEMARK OFFICE

CERTIFICATE OF CORRECTION

PATENT NO. : 5,177,537

DATED : January 5, 1993

INVENTOR(S) : OKANO, ET AL.

It is certified that error appears in the above-identified patent and that said Letters Patent is hereby corrected as shown below:

Title page, item

[30] Foreign Application Priority Data

"Dec. 20, 1989 [JP] Japan 2-332202
Jun. 29, 1990 [JP] Japan 3-173765" should read --Dec. 20, 1989 [JP] Japan 1-332202
Jun. 29, 1990 [JP] Japan 2-173765--.

Title page, item

[56] FOREIGN PATENT DOCUMENTS

"1-277264; 11/1989 Japan" should read
--1-277265 11/1989 Japan--.

COLUMN 1

Line 17, "urqed" should read --urged--.
Line 41, "show" should read --shown--.

COLUMN 2

Line 20, "a" (first occurrence) should read --an--.

COLUMN 3

Line 65, "changes" should read --change--.

COLUMN 8

Line 13, "charge" should read --charged--.
Line 30, "is" should be deleted (second occurrence).

UNITED STATES PATENT AND TRADEMARK OFFICE

CERTIFICATE OF CORRECTION

PATENT NO. : 5,177,537

DATED : January 5, 1993

INVENTOR(S) : OKANO, ET AL.

It is certified that error appears in the above-identified patent and that said Letters Patent is hereby corrected as shown below:

COLUMN 9

Line 49, "form" should read --from--.

COLUMN 10

Line 42, "claim 3," should read --claim 2,--.

COLUMN 12

Line 13, "t" should read --to--.
Line 26, "claim 14" should read --claim 14,--.

Signed and Sealed this

Thirtieth Day of November, 1993

*Attest:*

*Attesting Officer*

BRUCE LEHMAN

*Commissioner of Patents and Trademarks*